United States Patent [19]

Miller

[11] 4,309,921

[45] Jan. 12, 1982

[54] CAN TOP OPENER

[75] Inventor: Raphael W. Miller, Jackson, Mich.

[73] Assignee: Liftab Corporation, Jackson, Mich.

[21] Appl. No.: 147,398

[22] Filed: May 7, 1980

[51] Int. Cl.[3] ..... B67B 7/00

[52] U.S. Cl. ..... 81/3.46 R; 220/274; 294/26

[58] Field of Search ..... 294/26, 99, 103 R; 81/3.34, 3.38 A, 3.46 R, 3.46 A, 3.37, 3.36, 3.38 R, 3.4, 3.44, 3.35; 220/274, 284

[56] References Cited

U.S. PATENT DOCUMENTS

| | | | |
|---|---|---|---|
| 3,235,122 | 2/1966 | Oblander | 220/274 |
| 3,459,075 | 8/1969 | Henderson | 81/3.34 |
| 3,460,411 | 8/1969 | Dyer | 81/3.34 |
| 3,656,375 | 4/1972 | Reed et al. | 81/3.46 |
| 4,120,216 | 10/1978 | Goldberg | 81/3.46 A |
| 4,132,135 | 1/1979 | Bujan | 81/3.46 A |
| 4,133,228 | 1/1979 | DePooter | 81/3.1 R |

*Primary Examiner*—James B. Marbert
*Attorney, Agent, or Firm*—Beaman & Beaman

[57] ABSTRACT

An opener for beverage cans utilizing "stay-on-tab" opening systems wherein the implement of the invention may be readily employed to open beverage cans employing such tabs without harm to the fingers. A stamped metal body includes a bridge adapted to be inserted under the container tab wherein raising the body handle portion lifts the tab and the nose end of the implement imposes a downward pressure on the scored container closure usually through the tab portion overlying the scored opening to deflect the closure to an open position providing access to the contents.

6 Claims, 6 Drawing Figures

CAN TOP OPENER

BACKGROUND OF THE INVENTION

For a number of years cans, particularly beverage cans, have employed self mounted openers wherein structure mounted upon the can lid permits an opening to be formed in the container providing access to the contents without employing a conventional can opener. In past years, the majority of containers of this type were commonly called "pop-top" or "pull ring" cans, and the opening structure usually included a metal ring which was riveted, or otherwise affixed, to a sealed tear-away closure defined on the can lid, the closure usually being defined by a scored line which permits the can lid material to be readily severed upon a sufficient pull being applied to the ring. When using pop-top cans the ring and scored closure were completely removed from the can, and often improperly discarded as to constitute litter.

In that the pull rings are relatively small, and the edges thereof are sometimes rather sharp, it is not uncommon for the user to cut a finger when opening a pop-top can. Danger to the fingers often occurs when an individual must open a plurality of pop-top cans in a relatively short time interval, as often occurs in commercial establishments.

A number of proposals have been made for implements usable with pop-top cans wherein the implement, rather than the fingers, operates the pull ring, and the implement holds the pull ring to discourage improper discarding thereof. Examples of such disclosures are found in U.S. Pat. Nos. 3,459,075; 3,460,411; 3,656,375; 4,120,216 and 4,133,228.

A number of states have now passed anti-litter or "bottle" statutes which prevent the distribution of beverage cans or containers having self-mounted opening devices which may be separated from the can, such as with the pop-top can and pull ring. In order to comply with the anti-litter laws of these states beverage containers utilizing self-mounted openers employ an opening system using tabs commonly called "stay-on-tabs". Such tabs are permanently affixed to the beverage can lid and function as a lever to inwardly displace and deform a scored closure defined on the container lid. The closure is forced inwardly by raising of the tab, and while the tab is pivoted relative to the can lid, it remains attached thereto with the result that access to the container contents is provided and neither the closure or tab is separated from the container.

Stay-on-tabs, prior to use, include a handle end which is located adjacent the can lid, often below the level of the can lid rim, and in order to permit the tab to be gripped for operation the user must use the fingernails to preliminarily raise the tab handle end sufficiently to permit adequate finger gripping for raising the tab handle to inwardly deflect the scored closure. The effort required to raise the tab handle often injures the fingers and fingernails, and if a plurality of containers must be opened extreme discomfort, cuts and bleeding is often encountered.

Opening implements such as those disclosed in the above identified patents for pop-top cans have not been widely distributed for stay-on-tab containers, and to the applicant's knowledge an opener implement for stay-on-tab containers has not been available.

It is an object of the invention to provide an opener for use with stay-on-tab containers wherein the opener may be readily inserted upon the tab, and functions to augment the opening action of the tab upon the opener being lifted to raise the tab.

A further object of the invention is to provide an opener for stay-on-tab containers wherein the opener is of an economical construction, may be readily manufactured and shipped, and permits the tab to be readily operated without danger to the hand or fingers.

In the practice of the invention the opener comprises a generally flat, stamped, steel body of elongated form having a nose end and a rear end. The body is of such length that the portion adjacent the rear end constitutes a handle, and the nose end is somewhat pointed to define an apex which serves as an abutment for imposing a leverage force upon the container tab, or scored opening.

The body is lanced intermediate the nose end and handle portion in a manner transverse to the body length wherein a bridge is defined extending from the lower side of the body which forms a base substantially parallel to the body plane and spaced there below. The base is affixed to the body by support elements formed of the body material, and the body, base, and support elements form a substantially rectangular opening adapted to receive the handle portion of a stay-on-tab. The bridge base is provided with a champhered or oblique surface which forms a sharp front edge on the bridge base facilitating entry of the tab into the bridge opening.

The opener is inserted upon the tab handle until the forward edge of the bridge base encounters the rivet holding the tab upon the can lid, or the tab structure adjacent the rivet, and at that time the apex of the nose end of the body is usually located directly above the abutment portion of the tab which is to impose the downward force upon the scored closure. Accordingly, upon the operator raising the handle portion of the body the fact that the tab handle portion is located within the bridge intermediate the bridge base and body will raise the tab about its rivet, which functions as a fulcrum, and both the tab and body nose end will impose a downward force upon the scored closure at the desired location to force the scored closure inwardly and provide access to the can contents. After use, the opener is merely pulled from the tab handle, and the tab may be pushed toward the plane of the can lid either by the body prior to removal thereof, or with the fingers, after the opener is removed from the tab.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
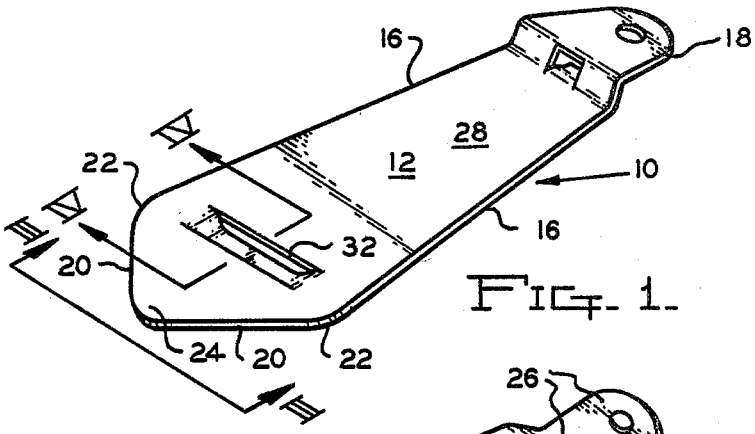
FIG. 1 is a perspective view of an opener in accord with the invention illustrating the upper side thereof.
Figure 3:
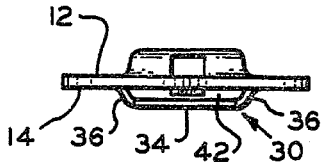
FIG. 3 is an end elevational view as taken from the nose end of the opener.
Figure 4:
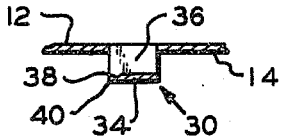
FIG. 4 is an enlarged, detail, sectional view taken through the bridge along Section IV—IV of FIG. 1.
Figure 2:
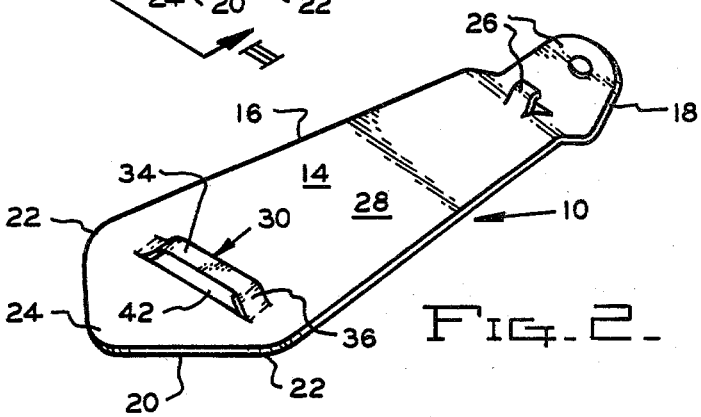
FIG. 2 is a perspective view of the lower side of the opener.

With reference to FIGS. 1–4, the opener in accord with the invention includes a steel metal body 10 of a generally flat or planar configuration. The body includes an upper surface 12 and a lower surface 14. Laterally, the body includes edges 16 which converge toward a rear end 18, and forward lateral edges 20 intersect edges 16 at rounded corners 22 and converge toward each other merging into the rounded apex nose end 24 of the body. The greatest width dimension of the body 10 occurs at the corners 22. If desired, the body rear end 18 may be provided with deformed hook and spur portions 26, the spur portion being lanced from the body, to form a conventional bottle cap opener. That portion of the body adjacent the rear end 18, intermediate lateral edges 16, constitutes the body handle portion 28.

A bridge 30 is lanced from the body 10 so as to extend from the lower surface 14 and defines an opening 32 in the body from which the bridge material is lanced, FIG. 1. The bridge is of a rectangular configuration and the shape of the bridge is best appreciated from FIGS. 2 and 3, and includes a base 34 of elongated linear configuration disposed directly below the opening 32 connected to the body at its ends by support elements 36. The base 34 is parallel to the plane of the body 10, and includes a champhered or oblique surface 38 extending in a downward and forward direction toward the nose end 24 to form a narrow edge with the base front edge 40. The purpose of the oblique surface 38 is to facilitate entrance of the tab handle into the opening 42 defined by the base 34, body 10 and support elements 36 as will be appreciated from FIG. 3.

Figure 5:
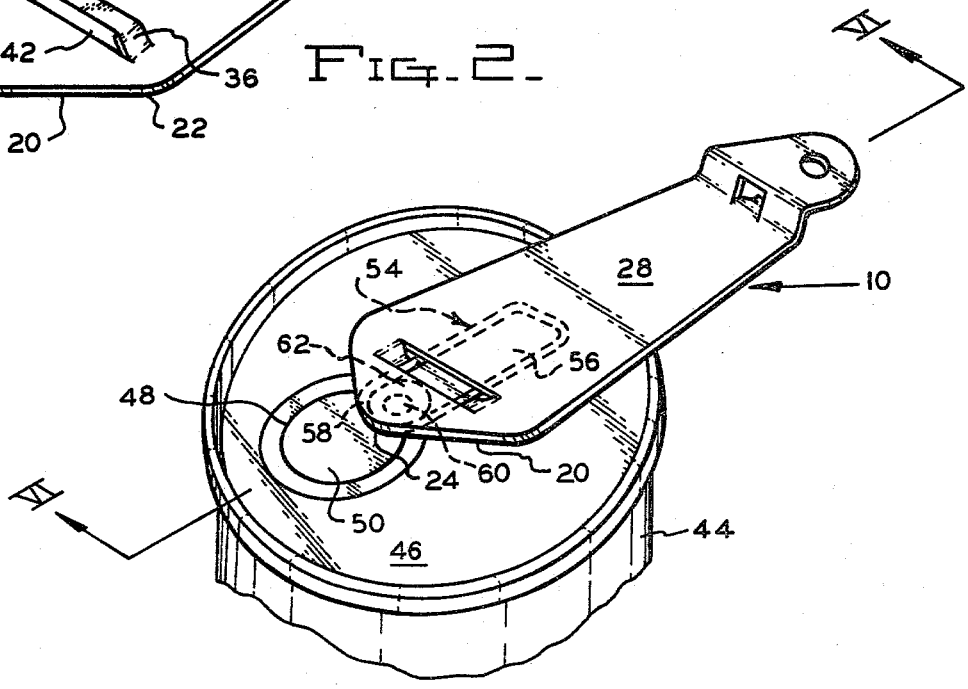
FIG. 5 is a partial, perspective view of the opener of the invention when fully placed upon a stay-on-tab associated with a can.
Figure 6:
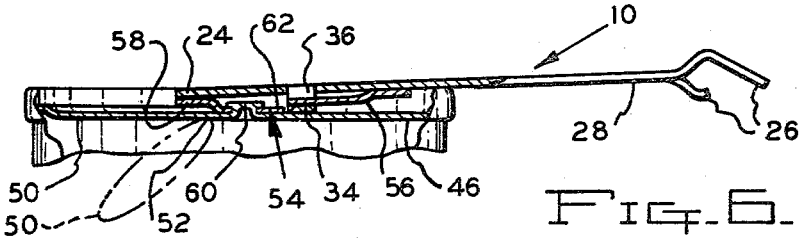
FIG. 6 is an elevational sectional view taken through Section VI—VI of FIG. 5.

A typical can having a stay-on-tab is illustrated in FIGS. 5 and 6. The can 44 includes a lid 46 wherein the lid is scored at 48 to define a closure 50 which will pivot inwardly about a hinge portion 52 shown in dotted lines in FIG. 6 to an open condition. The tab 54 is formed of metal and includes a handle portion 56, and an abutment portion 58 superimposed over a portion of the closure 50 adjacent hinge portion 52, and the tab is affixed to the lid by an integral rivet 60, FIG. 6. The tab is severed at 62 about a portion of the rivet 60 to form a hinge wherein the tab may be pivoted relative to the rivet to form a lever such that raising of the handle 56 pivots the abutment portion 58 downwardly into engagement with the closure 50 to sever the closure from the lid scoring 48 and bend the closure inwardly providing access to the can contents. After opening, the handle portion 56 may be pushed downwardly toward the lid 46 so that the tab is not in the way if it is desired to drink directly from the can.

To use the opener of the invention, the body 10 is disposed substantially parallel to the can lid as in FIG. 6 with the nose end 24 of the body disposed over the tab handle 56, and the handle 56 will be in alignment with the bridge opening 42. The opener is moved in the direction of the rivet 60 wherein the tab handle will enter the opening 42 as facilitated by the base surface 38, and this action may raise the tab handle slightly. Continued movement of the body 10 on the tab 54 will take place until the base edge 40 encounters the tab material surrounding the rivet, or the rivet directly, and at this time the body nose end 24 will normally be disposed directly above the abutment portion 58 of the tab, as shown in FIG. 5. Thereupon, the operator raises the body handle portion 28 causing the base 34 to raise tab handle 56, and this action simultaneously forces the tab abutment 58 downwardly into engagement with the closure 50, and forces the body nose end 24 onto the tab abutment 58. The length of the body 10 is such to permit sufficient downward forces to be imposed on the closure 50 to fully open the closure without excessive force being applied to the body handle, and as the tab is raised it is often possible to push the body further on the tab toward the rivet 60 due to clearance of the tab material about the rivet which will permit the body nose end 24 to directly engage the closure 50 to produce additional opening forces and pressure on the closure for pivoting the same to a more open position.

After use, the body may be pulled away from the tab removing the tab from the opening 42, and the tab 54 may be depressed by the finger. Alternately, the body 10 may be repivoted to the position of FIG. 6, which will "lower" the tab handle 56, and then the opener body be removed therefrom.

The length of the bridge 30, and opening 32, is approximately ½ inch less than the width of the body at corners 22 to insure sufficient body strength to prevent the nose end from bending relative to the handle position 28, and the axial dimension from the edge 40 to the nose end 24 is such that the nose end will always be superimposed over a deflectable portion of the closure 50 when the edge 40 engages, or substantially engages, the rivet 60.

The construction of the opener permits stay-on-tabs to be quickly and easily operated without harm to the fingers. As the opener may be economically manufactured and operated with ordinary skill it is readily acceptable for use by all, and as the opener does not remove the tab or closure from the lid no violation of state law occurs.

It is appreciated that various modifications to the inventive concepts may be apparent to those skilled in the art without departing from the spirit and scope of the invention.

I claim:

1. An opener for cans having a lid including a scored closure adapted to be displaced inwardly by a levered tab affixed adjacent the closure by a fastening element attached to the lid, the tab including a handle portion adapted to be raised away from the can lid defined on one side of the fastening element and a closure depressing portion defined on the other side of the fastening element, the opener comprising a generally elongated planar body having upper and lower sides, a nose end, and a handle portion, a tab handle portion engaging element defined on said body intermediate said nose end and body handle portion extending below said body lower side defining an opening adapted to receive a tab handle portion, said tab handle portion engaging element comprising an elongated bridge lanced from said body having a length transverse to the body length, said bridge including a base spaced from said body having ends connected to said body by support elements, said bridge being spaced from said nose end in the direction of the length of said body at a position which superimposes said nose end over a portion of the closure upon the body being inserted over the tab with the tab handle portion received within said opening and said bridge substantially engaging the tab fastening element whereby said nose end aids in the inward displacement of the closure upon raising said body handle portion.

2. In an opener for cans as in claim 1 wherein said bridge base includes a sharpened front edge disposed in the direction of said body nose end to facilitate entry of the tab handle portion into said opening defined by said bridge.

3. In an opener for cans as in claim 2, a surface defined on said bridge base oblique to the length of said body and intersecting said front edge defining said sharpened front edge, said oblique surface extending toward said front edge away from said body in the direction of said nose end.

4. An opener for beverage cans having a stay-on-tab closure, comprising a generally flat elongated steel body having upper and lower sides, a nose end, a rear end, and a handle portion defined adjacent said rear end, an apex defined at said nose end, a bridge lanced from said body extending from said lower side intermediate said nose end and handle portion comprising an elongated base spaced from said lower side extending substantially perpendicularly to the length of said body, said base including ends connected to said body by support elements, said body and base defining a tab receiving opening and said apex defining a tab engaging abutment.

5. In an opener as in claim 4, said bridge base having a front edge disposed in the direction of said body nose end, and a champhered surface defined on said bridge base intersecting said front edge defining a sharpened edge at said front edge.

6. In an opener as in claim 5 wherein said champhered surface is oblique to the length of the body and extends toward said front edge away from said body in the direction of said nose end.

* * * * *